United States Patent [19]

Mumford

[11] 4,337,678

[45] Jul. 6, 1982

[54] THREADED CLOSURE REMOVAL TOOL

[75] Inventor: George V. Mumford, Toledo, Ohio

[73] Assignee: Owens-Illinois, Inc., Toledo, Ohio

[21] Appl. No.: 249,048

[22] Filed: Mar. 30, 1981

[51] Int. Cl.[3] ..... B67B 7/18

[52] U.S. Cl. ..... 81/3.4; 81/3.1 R; D8/38

[58] Field of Search ..... 81/3.4, 3.34, 3.1 R, 81/3.3 R, 3.3 A; D8/18, 33, 38, 40; 7/151

[56] References Cited

U.S. PATENT DOCUMENTS

| | | | |
|---|---|---|---|
| D. 245,384 | 8/1977 | Ashton . | |
| D. 249,452 | 9/1978 | Gendron . | |
| 1,615,196 | 1/1927 | Lilja . | |
| 2,458,329 | 1/1949 | Archer . | |
| 2,519,447 | 8/1950 | Ensminger . | |
| 2,589,693 | 3/1952 | Hess . | |
| 2,631,482 | 3/1953 | Rinehart . | |
| 2,641,943 | 6/1953 | Krize, Jr. | 81/3.4 |
| 3,048,067 | 8/1962 | Miles et al. | 81/3.4 |
| 3,812,741 | 5/1974 | Heine . | |
| 4,001,904 | 1/1977 | Gill . | |

FOREIGN PATENT DOCUMENTS

| | | | |
|---|---|---|---|
| 44336 | 10/1938 | Netherlands | 81/3.4 |
| 97945 | 1/1940 | Sweden | 81/3.4 |
| 808 | of 1893 | United Kingdom | 81/3.3 |

*Primary Examiner*—Roscoe V. Parker

*Attorney, Agent, or Firm*—John R. Nelson; Myron E. Click; David H. Wilson

[57] ABSTRACT

A manually operable tool for removing threaded closures from the necks of bottles is provided. Such tool constitutes a one piece molded plastic structure of generally oval-shaped horizontal configuration having a peripheral depending wall by which torque applied by the fingers may be transmitted to the tool. Within the boundaries of the peripheral wall, a depending circular wall is integrally formed and portions of such circular wall are integral with portions of the peripheral wall. The circular wall is provided with appropriate internal projections or ribs to engage similar ribs or depressions provided on the closure for which the tool is designed.

3 Claims, 6 Drawing Figures

THREADED CLOSURE REMOVAL TOOL

BACKGROUND OF THE INVENTION

1. Field of the Invention

The invention relates to a tool for expediting the manual removal of closures which are threadably secured to the necks of containers and require a substantial torque to be applied thereto to effect their removal.

2. Description of the Prior Art

There are literally hundreds of patents relating to manual tools for facilitating the removal of closures from containers. The difficulty of manual removal of such screw type closures, particularly for bottles containing beer and soft drinks, has not dimmed the enthusiasm of the packers for the use of such closures.

Two common types of closures are in wide spread current use. The first is the so-called "twist crown" which is employed primariliy in the packaging of beer and embodies a conventional crown exterior configuration, but the internal plastic liner of the crown is deformed to snugly engage external threads provided on the extreme rim portion of the bottle neck. Needless to say, the closure must be tightly applied, because it has to withstand internal pressure generated by its carbonated contents, particularly when exposed to elevated temperatures, as well as the rough handling inherently involved in the transport of the filled container from the brewer to the ultimate consumer.

The second common type of closure is that which is commonly known as the "twist open" aluminum cap. Such cap is fabricated by placing an aluminum cap shell around the top threaded neck portion of a bottle and then rolling threads into the aluminum shell to effect the securement of the cap to the bottle neck. Additionally, it is common to roll a bottom band portion of the cap beneath a retaining shoulder provided on the bottle neck, and to connect such band portion to the remainder of the aluminum cap shell by a series of frangible bridges which are severed upon the initial application of opening torque to the cap. An alternate procedure for providing the pilfer proof feature is to provide axial scores in the pilfer proof band portion which are severed when torque is initially applied to the aluminum cap, permitting the band portion to expand and move upwardly over the retaining shoulder on the bottle.

With all of these commonly used closures, it is still a matter of considerable difficulty, particularly for the elderly and children, to manually remove the closure from the bottle. There is, therefore, a need for an economical, reliable opening tool for removing threaded type closures from bottles. Such tools appear in abundance in the prior art but have heretofore involved complicated and relatively expensive constructions.

SUMMARY OF THE INVENTION

The invention provides a simple tool for removing a closure that is threadably secured to a bottle neck through the application of a manually applied torque. The tool is molded in a single piece and includes a top element formed in a generally oval-shaped configuration. Around the perimeter of such top portion, a depending wall or flange is secured which serves to rigidify the top portion and also to act as a convenient surface upon which the opening torque may be applied by the fingers. In the central portion of the oval-shaped top, an integral depending circular wall or rib is provided, having diametrically opposed portions of its periphery integral with the depending peripheral wall. This serves to readily transmit the torque forces from the peripheral wall to the circular depending rib. The interior of the rib is provided with appropriate axially extending shoulders which either engage external grooves or spaced ribs commonly provided on the screw-threaded closures for which the tool is designed. Hence, the application of the tool to the end of the closure will permit the interengagement of the ribs on the depending circular wall of the tool with the grooves or ribs commonly provided on the exterior of the threaded closure and the application of torque by the fingers, particularly to the end portions of the oval-shaped depending peripheral flange, will apply a substantial torque to the closure insuring its ready removal from the bottle.

Further objects and advantages of the invention will be readily apparent to those skilled in the art from the following detailed description, taken in conjunction with the annexed sheets of drawings, on which are shown two preferred embodiments of the invention.

DESCRIPTION OF THE PREFERRED EMBODIMENT

Figure 1:
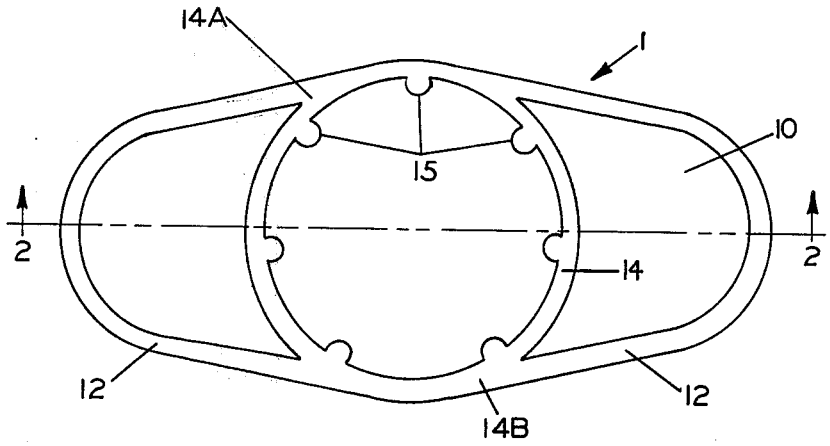
FIG. 1 is a bottom plan view of a closure removing tool constructed in accordance with this invention.
Figure 2:
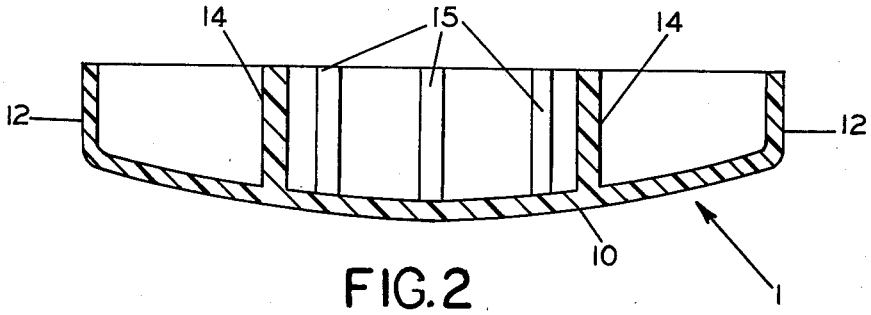
FIG. 2 is a sectional view taken on the plane 2—2 of FIG. 1.

Referring now FIGS. 1 and 2, there is shown a closure opening tool 1 embodying this invention. Tool 1 is molded in a single piece from either a thermosetting or thermoplastic resin. A tough, durable thermoplastic resin, such as polypropylene, is preferred, due to the fact that the inherent resilience of such resin will readily accommodate for the slight dimensional differences that occur between successive closures that are encountered by the tool 1. Furthermore, there is less likelihood of cracking such a thermoplastic material.

Figure 3:
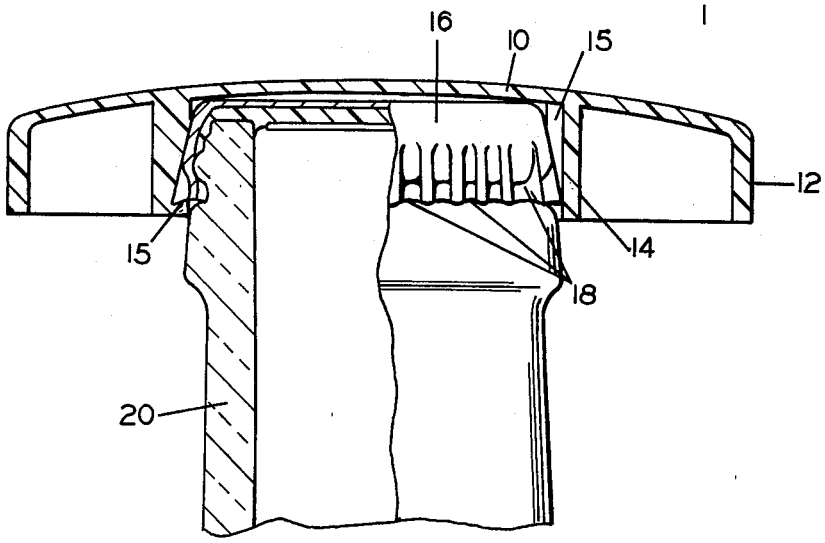
FIG. 3 illustrates the application of the tool of FIGS. 1 and 2 to effect the removal of a "twist crown" closure assembled to a bottle.

In any event, the tool 1 comprises an upper base portion 10 of generally oval configuration which has a depending peripheral flange 12 integrally formed thereon. The flange 12 thus provides a convenient grasping point for the fingers to apply a substantial torque to the opening tool. In the central portions of the wall 10, a circular wall 14 is integrally formed in depending relationship. Diametrically opposed portions **14*a* and 14*b* of depending circular wall 14 are integral with the integrally formed depending peripheral flange 12, thus facilitating the transmission of torque from such peripheral flange 12 to the circular wall 14. At spaced intervals around the inner periphery of the depending wall 14 a plurality of internally projecting lugs or ribs 15 are provided which are suitably shaped and spaced so as to respectively engage the grooves 18 which are commonly provided on the upper corner of a twist crown closure 16, which is shown in FIG. 3 in assembled relationship to a bottle neck 20**.

To operate the tool 1, it is only necessary to apply the circular depending wall 14 in surrounding relationship to the twist crown 16, with the ribs 15 of the tool 1 respectively engaging the grooves 18 of the crown 16 and then exert a twisting force on the peripheral flange 12 of the tool 1 to effect an opening and removal of the closure 16 from the bottle.

Figure 4:
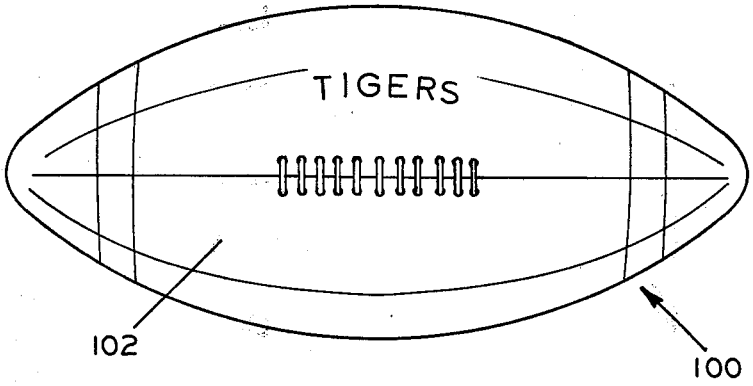
FIG. 4 is a top plan view of a modified form of closure removal embodying this invention.
Figure 5:
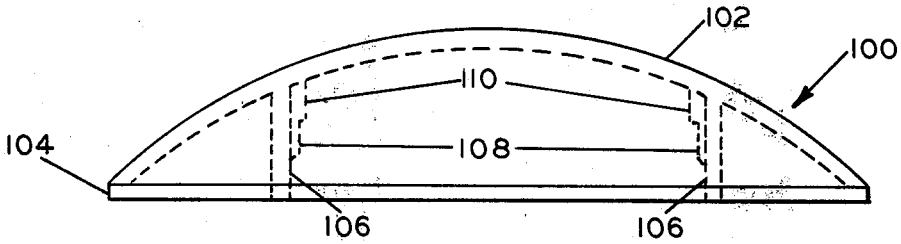
FIG. 5 is a side elevational view of FIG. 4.
Figure 6:
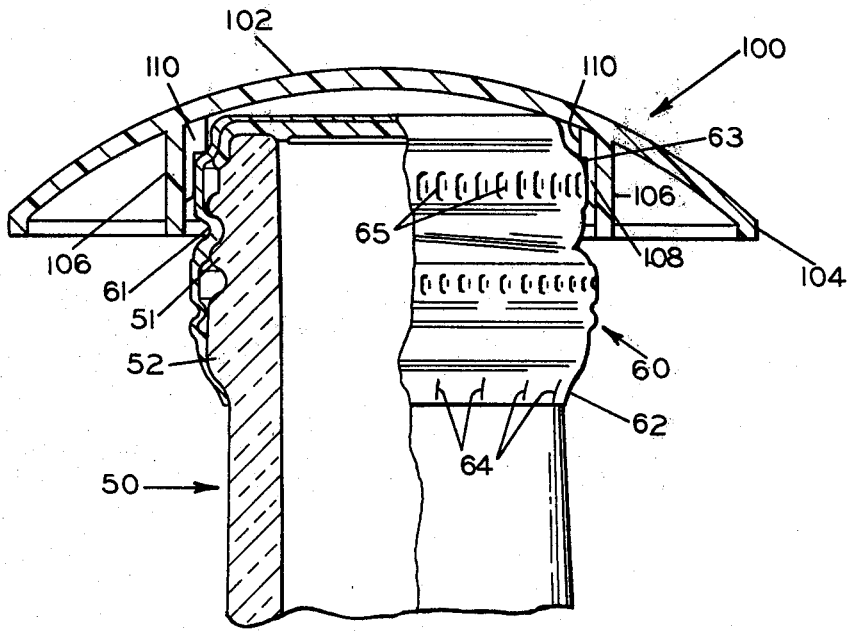
FIG. 6 is a vertical sectional view illustrating the assemblage of the tool shown in FIGS. 4 and 5 to a pilfer proof type twist off aluminum cap assembled to a beverage type bottle.

Referring now to FIGS. 4 through 6, there is shown a modification of this invention which provides a tool 100 specifically designed for the removal of the so-called pilfer proof twist-off aluminum caps from the threaded necks of beverage bottles. Such beverage bottles 50 are provided with a threaded neck portion 51 below which there is provided an integral outward projecting retaining shoulder 52. The aluminum closure 60 is originally applied to the neck of the bottle in the form of a cap shell, and then is rolled into intimate engagement with the external surfaces of the threaded neck 51, thus forming threads 61 and rolling a bottom band portion 62 of the aluminum cap into engagement with the bottle neck below the retaining shoulder 52. At a plurality of peripherally spaced points around the band portion 62, there is provided slits or lines of weakness 64 which separate upon the application of a removal torque to the cap 60 and permit the band portion 62 to readily slide over the retaining shoulder 52 on the bottle neck.

The removing tool 100 embodying this invention again involves a main body panel 102 which is of generally oval-shaped configuration, but in both a horizontal and vertical plane, and thus resembles one-half of a football. Around the perimeter of panel 102, an integral depending peripheral flange 104 is provided which permits the convenient application of opening torque to the tool by the fingers. In the center portion of panel 102 there is provided an integral depending circular wall or rib 106. Diametrically opposed portions of the circular wall 106 are integral with the peripheral flange 104 and thereby facilitate the transmission of torque from the flange 104 to the circular wall 106. At spaced intervals around the inner periphery of the circular wall 106 there are provided a plurality of inward projections or ribs 108 which are suitably shaped and spaced so as to engage between projections 65 commonly provided on the side wall portions of the aluminum closure 60.

To further strengthen circular wall 106, an annular fillet 110 may be provided between the top inner portion of wall 106 and the top panel 102. The fillet 110 conveniently rests on the upwardly facing shoulder 63 commonly provided on cap 60.

To effect the removal of the aluminum closure 60 from the bottle 50 it is only necessary to apply the circular wall portion 106 over the exterior of the aluminum closure 60 with the ribs 108 engaging between the projections 65 provided on the closure 60. The application of a torque by the fingers to the oval-shaped peripheral flange 104 will provide an adequate torque to effect the opening and removal of the closure 60 from a bottle 50.

Due to the unique shape of the tool 100, the top surface of the panel portion 102 may be appropriately decorated to resemble a football, and indicia may also be applied to such top surface, indicating either the name of a local team or the name of a bottled product merchandized in the particular area. Thus, the opening tool 100 becomes a valuable advertising give-away for promoters of sports events or for bottlers or brewers.

Obviously, the tool 100 may employ a cap engaging circular wall 106 of greater height than the wall 14 of the tool 1, due to the fact that the twist-off cap 60 has a substantially greater axial dimension than the twist crown 16 for which the tool 1 shown in the modifications of FIGS. 1 and 2 was specifically designed. In any event, however, the depth of the circular wall 106 must be limited so that the end of such wall does not extend into close proximity with the annular retaining shoulder 52 provided on the bottle 50, so as to avoid any interference with the movement of the retaining band portions 62 of the closure 60 over such retaining shoulder.

Modifications of this invention will be readily apparent to those skilled in the art and it is intended that the scope of the invention will be determined solely by the appended claims.

What is claimed is:

1. A hand operated tool for removing a threaded closure from a threaded bottle neck, said closure having a plurality of vertical grooves peripherally spaced around its upper exterior portion, comprising in combination, a molded plastic body having an oval-shaped top element, an integral vertical flange depending from the perimeter of said top element and engageable by the fingers to impart torque to the tool, a circular integral wall depending from and closed at one end by said top element and centrally located within the perimeter of said vertical peripheral flange, diametrically opposed portions of said circular wall being integral with said peripheral flange to facilitate the transmission of torque to said circular wall, with said wall and flange having the same vertical height in said integral portions, and a plurality of peripherally spaced vertical ribs on the inner surface of said circular wall respectively adapted to engage the vertical grooves of the closure by application of said circular wall in surrounding relationship thereto.

2. A hand operated tool for removing a threaded pilfer proof closure from a threaded bottle neck, said closure having a retaining band on its lower periphery which is inwardly deformed to engage beneath a shoulder on the bottle neck disposed below the neck threads, said closure further having a plurality of peripherally spaced vertical ribs on its upper exterior portion, comprising in combination, a molded plastic body having an oval-shaped top element, an integral vertical flange depending from the perimeter of said top element and engageable by the fingers to impart torque to the tool, and a circular integral wall depending from and closed at one end by said top element and centrally located within the perimeter of said vertical peripheral flange, diametrically opposed portions of said circular wall being integral with said peripheral flange to facilitate the transmission of torque to said circular wall, with said wall and flange having the same vertical height in said integral portions, and a plurality of peripherally spaced vertical ribs on the inner surface of said circular wall respectively adapted to engage between the vertical ribs of a pilfer proof closure by application of said circular wall in surrounding relationship thereto.

3. A hand operated tool for removing a threaded pilfer proof closure from a threaded bottle neck, said closure having a retaining band on its lower periphery which is inwardly deformed to engage beneath a shoulder on the bottle neck disposed below the neck threads, said closure further having a plurality of peripherally spaced vertical ribs on its upper exterior portion, comprising in combination, a molded plastic body having an oval-shaped top element, an integral vertical flange depending from the perimeter of said top element and engageable by the fingers to impart torque to the tool and a circular integral wall depending from and closed at one end by said top element and centrally located within the perimeter of said vertical peripheral flange, diametrically opposed portions of said circular wall being integral with said peripheral flange to facilitate the transmission of torque to said circular wall, with said wall and flange having the same vertical height in said integral portions, and a plurality of peripherally spaced vertical ribs on the inner surface of said circular wall respectively adapted to engage between the vertical ribs of a pilfer proof closure by application of said circular wall in surrounding relationship thereto, the depth of said circular wall being limited to terminate above said retaining shoulder on said bottle neck.

* * * * *